US007214279B2

(12) United States Patent
Fischer et al.

(10) Patent No.: US 7,214,279 B2
(45) Date of Patent: May 8, 2007

(54) AL/CU/MG/AG ALLOY WITH SI, SEMI-FINISHED PRODUCT MADE FROM SUCH AN ALLOY AND METHOD FOR PRODUCTION OF SUCH A SEMI-FINISHED PRODUCT

(75) Inventors: Gernot Fischer, Meinerzhagen (DE); Dieter Sauer, Meinerzhagen (DE); Gregor Terlinde, Meinerzhagen (DE)

(73) Assignee: Otto Fuchs KG, Meinerzhagen (DE)

( * ) Notice: Subject to any disclaimer, the term of this patent is extended or adjusted under 35 U.S.C. 154(b) by 478 days.

(21) Appl. No.: 10/501,574

(22) PCT Filed: Jun. 29, 2002

(86) PCT No.: PCT/EP02/07193

§ 371 (c)(1),
(2), (4) Date: Jul. 13, 2004

(87) PCT Pub. No.: WO2004/003244

PCT Pub. Date: Jan. 8, 2004

(65) Prior Publication Data

US 2005/0115645 A1 Jun. 2, 2005

(51) Int. Cl.
*C22C 21/12* (2006.01)
*C22F 1/057* (2006.01)

(52) U.S. Cl. ..... 148/417; 148/692; 148/694; 148/697; 148/700; 420/535; 420/539

(58) Field of Classification Search ..... 148/417, 148/692, 694, 697, 700; 420/535, 539
See application file for complete search history.

(56) References Cited

U.S. PATENT DOCUMENTS 3,475,166 A * 10/1969 Raffin ..... 420/532

FOREIGN PATENT DOCUMENTS

| | | |
|---|---|---|
| GB | 1320271 | 6/1973 |
| JP | 03107440 | 7/1991 |

OTHER PUBLICATIONS

Fabrication and Finishing of Aluminum Alloys/ Article XP-002227160 FORGING pp. 247-257; Heat Treating pp. 290-320. Materials Science Forum vol. 217-222 (1996) pp. 1759-1764. Copyright 1996 Transtec Publications, Switzerland. Aluminium Alloys—Their Physical and Mechanical Properties, "After Concorde: Evaluation of An Al-Cu-Mg-Ag Alloy For Use In the Proposed European SST".

* cited by examiner

*Primary Examiner*—Roy King
*Assistant Examiner*—Janelle Morillo
(74) *Attorney, Agent, or Firm*—Margaret Polson; Patent Law Offices of Rick Martin, PC

(57) ABSTRACT

An Al/Cu/Mg/Mn alloy for the production of semi-finished products with high static and dynamic strength properties has the following composition: 0.3–0.7 wt % silicon (Si), max. 0.15 wt. % iron (Fe), 3.5–4.5 wt % copper (Cu), 0.1–0.5 wt. % manganese (Mn), 0.3–0.8 wt. % magnesium (Mg), 0.5–0.15 wt % titanium (Ti), 0.1–0.25 wt % zirconium (Zr), 0.3–0.7 wt. % silver (Ag), max. 0.05 wt. % others individually, max 0.15 wt. % others globally, the remaining wt. % aluminum (Al). The invention further relates to a semi-finished product made for such an alloy and a method of production of a semi-finished product made for such an alloy.

15 Claims, 5 Drawing Sheets

Alloy E — AA 2214 — AA 2219 — AA 2618

$$LMP = [(T_{test} + 273.15)*(20 + \log t_{fatigue})]/1000$$

AL/CU/MG/AG ALLOY WITH SI, SEMI-FINISHED PRODUCT MADE FROM SUCH AN ALLOY AND METHOD FOR PRODUCTION OF SUCH A SEMI-FINISHED PRODUCT

CROSS REFERENCE APPLICATIONS

This application is a national phase application claiming priority from PCT application no. PCT/EP2002/07193 filed on 29 Jun. 2002.

FIELD OF INVENTION

Subject matter of the invention is an Al/Cu/Mg/Mn alloy for the production of semi-finished products with high static and dynamic strength properties. The invention further relates to semi-finished products manufactured from such an alloy with high static and dynamic strength properties as well as to a method for the production of such a semi-finished product.

BACKGROUND OF THE INVENTION

Aluminum alloys having a high static and dynamic bearing capacity include the alloys AA 2014 and AA 2214. Drop-forged parts for wheel and brake systems of airplanes are manufactured from these Al alloys in the artificially aged state. The semi-finished products produced from the alloy intrinsically have the listed strength properties of the alloys, especially at lower temperatures. However, at temperatures of more than 100° C. these properties decrease more rapidly than is the case with alloys of the group AA 2618.

Semi-finished products of the alloys of group AA 2618 have better high-temperature stability and are utilized for a variety of uses such as compressor impellers for rechargeable diesel engines or for rotors of ultracentrifuges. However, at temperatures below 100° C., the aluminum alloys of the group AA 2014 and AA 2214 have greater bearing capacity.

In the wheel brake system of airplanes considerable heat is generated during the braking process. This leads to temperature increases even in the wheels, which typically are fabricated of an AA 2014 or AA 2214 alloy. These can cause early overageing of this alloy and lead to a severe limitation of the service life of the structural part.

In compressor impellers the transition to titanium alloys has been made to give the compressor impellers the necessary static and dynamic strength properties even at increased temperatures. However, employing titanium is expensive is therefore not suitable for the production of airplane wheels. Furthermore, titanium is less well suited as a material for wheels due to its limited thermal conductivity.

The problematic described above is not new. Therefore, for many years there has been the wish for an Al alloy, which combines the high strength properties of the alloys AA 2014 or AA 2214 at ambient temperature and the thermal stability of the alloys AA 2618 or 2618 A.

SUMMARY OF THE INVENTION

The invention therefore addresses the problem of providing such an alloy, a semi-finished product produced of such an alloy with high static and dynamic bearing capacity, high thermal stability, high fracture toughness and high creep resistance as well as a method for the production of such semi-finished products.

Other aspects of this invention will appear from the following description and appended claims, reference being made to the accompanying drawings forming a part of this specification wherein like reference characters designate corresponding parts in the several views.

This problem is solved according to the invention with an alloy that has the following composition:

0.3–0.7 wt. % silicon (Si)
maximally 0.15 wt. % iron (Fe)
3.5–4.5 wt. % copper (Cu)
0.1–0.5 wt. % manganese (Mn)
0.3–0.8 wt. % magnesium (Mg)
0.05–0.15 wt. % titanium (Ti)
0.1–0.25 wt. % zirconium (Zr)
0.3–0.7 wt. % silver (Ag)
maximally 0.05 wt. % other, individually
maximally 0.15 wt. % other, total
remaining wt. % aluminum (Al).

Compared to the prior known alloys AA 2014 and AA 2214, the claimed alloy has higher static and dynamic thermal stability and improved creep resistance while also having very good mechanical fracturing properties. These properites are attained in particular at a copper-magnesium ratio between 5 and 9.5, in particular at a ratio between 6.3 and 9.3. The copper content is preferably between 3.8 and 4.2 wt. % and the magnesium content between 0.45 and 0.6 wt. %. The copper content is markedly below the maximum solubility for copper in the presence of the claimed magnesium content. As a consequence, the fraction of insoluble copper-containing phases is very low, also taking into consideration the remaining alloy and companion elements. Thereby an improvement is obtained with respect to the dynamic properties and the fracture toughness of the semi-finished products manufactured from such an alloy.

In contrast to the known AA alloys 2014 and 2219, a portion of the claimed alloy is silver with contents between 0.3 and 0.7 wt. %, preferably 0.45 and 0.6 wt. %. In the interaction with silicon (0.3–0.7 wt. %, preferably 0.4–0.6 wt. %) the hardening takes place via the same mechanisms as in silver-free Al/Cu/Mg alloys. However, it has been found that with lower silicon contents, the course of precipitation is different due to the addition of silver.

While the semi-finished products manufactured from such an alloy have good high-temperature stability and creep resistances under cooler conditions, they do not meet the desired requirements. Only silicon contents above 0.3 wt. % suppress the otherwise typical change of the precipitation behavior of Al/Cu/Mg/Ag alloys, such that unexpectedly higher strength values can be attained without having to give up the high-temperature stability and the creep resistance with the Cu and Mg contents according to the invention.

The manganese content of the claimed alloy is 0.1 to 0.5 wt. %, preferably 0.2–0.4 wt. %. In the case of alloys with higher manganese contents undesirable precipitation processes were found with long-term high-temperature stress, which led to a decrease of strength. For this reason the manganese content is limited to 0.4 wt. %. However, manganese is fundamentally required as an alloy component for the control of the grain structure.

To balance the reducing effect of manganese with respect to the grain structure control, the alloy contains zirconium between 0.10–0.25 wt. %, preferably 0.14–0.20 wt. %. The precipitating zirconium aluminides, as a rule, are developed even more finely dispersed than manganese aluminides. Moreover, it was found that the zirconium aluminides contribute to the thermal stability of the alloy.

For grain sizing 0.05–0.15 wt. %, preferably 0.10–0.15 wt. % of titanium is added. The titanium is usefully added in the form of an Al/5Ti/1B prealloy, whereby boron is automatically included in the alloy. Finely dispersed, insoluble titanium diborides are formed therefrom. These contribute to the thermal stability of the alloy.

The alloy can comprise maximally 0.15% iron, preferably 0.10%, as an unavoidable contamination.

Figure 1:
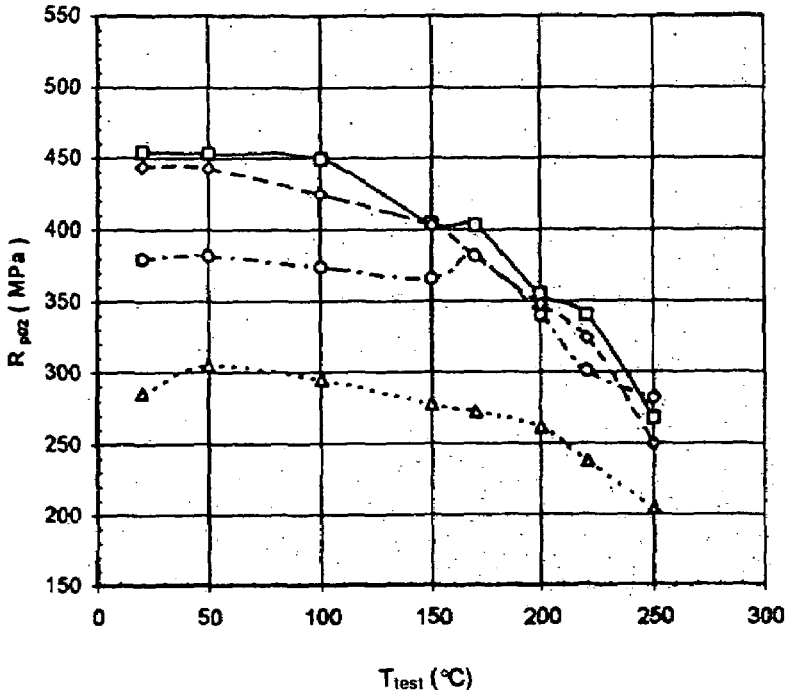
FIG. 1 is a graph showing the 0.2% yield strength and the tensile strength of the alloy according to the invention in state T6in comparison to prior known alloys, as a function of the test temperature.
Figure 1:
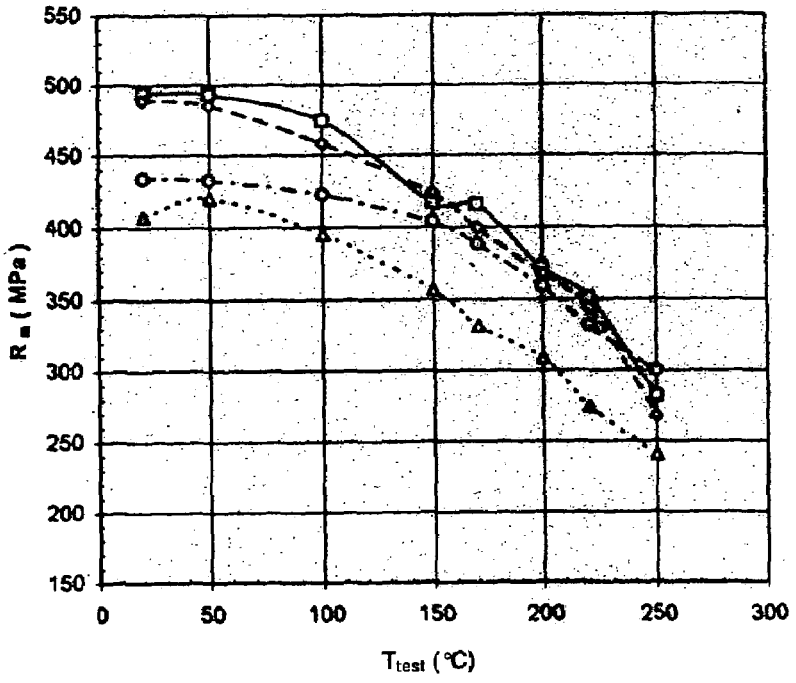

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE INVENTION

Table 1 reproduced below shows the chemical composition of four alloys (B, C, D, E) according to the invention as well as the composition of the alloys AA 2214 and AA 2618 examined as a comparison (data in wt. % (n.d.: not determined)

TABLE 1

| Alloy | Si | Fe | Cu | Mn | Mg | Ni | Zn | Ti | Ag | Zr | V |
|---|---|---|---|---|---|---|---|---|---|---|---|
| B | 0.47 | 0.08 | 4.40 | 0.200 | 0.58 | 0.003 | 0.048 | 0.135 | 0.45 | 0.150 | 0.018 |
| C | 0.47 | 0.08 | 3.64 | 0.210 | 0.59 | 0.003 | 0.015 | 0.115 | 0.52 | 0.150 | 0.017 |
| D | 0.47 | 0.08 | 3.87 | 0.200 | 0.61 | 0.003 | 0.015 | 0.117 | 0.52 | 0.150 | 0.019 |
| E | 0.52 | 0.08 | 4.14 | 0.200 | 0.61 | 0.003 | 0.02 | 0.115 | 0.44 | 0.150 | 0.018 |
| AA 2214 | 0.77 | 0.17 | 4.29 | 0.883 | 0.57 | 0.003 | 0.031 | 0.024 | 0.003 | 0.007 | n.d. |
| AA 2618 | 0.22 | 1.1 | 2.58 | 0.020 | 1.53 | 1.007 | 0.043 | 0.059 | 0.003 | 0.002 | n.d. |

From these alloys semi-finished products were manufactured following the method steps listed below:

a) casting of an ingot from an alloy, b) homogenizing the cast ingot at a temperature, which is as close under the incipient melting temperature of the alloy as is possible, for a length of time adequate to attain maximally uniform distribution of the alloy elements in the cast structure, c) hot working of the homogenized ingot by forging at a block temperature of approximately 420° C., d) solution treatment of the semi-finished product worked by forging at temperatures sufficiently high to bring the alloy elements necessary for the hardening into solution such that they are uniformly distributed in the structure, with the solution treatment taking place in a temperature range of 505° C. over a time period of 3 hours, e) quenching of the solution-treated semi-finished product in water at ambient temperature, f) cold working of the quenched semi-finished products by cold upsetting by 1 to 2%, and g) artificial ageing of the quenched semi-finished product at a temperature of 170° C. over time period of 20 to 25 hours. The open-die forged pieces produced in this manner were subsequently tested for their properties in the artificially aged state T6.

TABLE 2

| Strength values at ambient temperature | | | | | Fracture toughness at ambient temp. | |
|---|---|---|---|---|---|---|
| Alloy | Sample direction | $R_{p02}$ (MPa) | $R_m$ (MPa) | $A_5$ (%) | Sample direction | $K_{IC}$ (MPa$\sqrt{m}$) |
| C | L | 448 | 485 | 11.2 | T-L | 31.3 |
| | LT | 427 | 471 | 7.2 | S-L | 29.5 |
| | ST | 417 | 479 | 6.3 | S-T | 32.2 |
| D | L | 456 | 495 | 10.7 | T-L | 28.3 |
| | LT | 434 | 478 | 8.0 | S-L | 29.1 |
| | ST | 429 | 484 | 5.5 | S-T | 29.6 |
| E | L | 454 | 494 | 9.9 | T-L | 26.1 |
| | LT | 446 | 493 | 6.4 | S-L | 25.5 |
| | ST | 438 | 494 | 4.9 | S-T | 26.9 |
| AA 2214 | L | 444 | 489 | 9.7 | T-L | 24.2 |
| | LT | 439 | 483 | 6.4 | S-L | 25.9 |
| | ST | 429 | 480 | 5.8 | S-T | 27.3 |
| AA 2219 | L | 286 | 408 | 16.7 | T-L | 31.1 |
| | LT | 288 | 403 | 8.4 | S-L | 34.4 |
| | ST | 366 | 455 | 5.0 | S-T | 32.3 |
| AA 2618 | L | 389 | 443 | 5.1 | T-L | 19.2 |
| | LT | 383 | 437 | 4.7 | S-L | 16.7 |
| | ST | 376 | 427 | 4.1 | S-T | 19.3 |

TABLE 3

| Alloy | | E | | | AA 2214 | | | AA 2618 | | |
|---|---|---|---|---|---|---|---|---|---|---|
| $R_{test}$ (° C.) | $T_{hold}$ (h) | $R_{p02}$ (Mpa) | $R_m$ (Mpa) | $A_5$ (%) | $R_{p02}$ (Mpa) | $R_m$ (Mpa) | $A_5$ (%) | $R_{p02}$ (Mpa) | $R_m$ (Mpa) | $A_5$ (%) |
| 20 | 1 | 454 | 494 | 9.9 | 444 | 489 | 9.6 | 380 | 434 | 6.5 |
| 50 | 1 | 453 | 493 | 12.6 | 443 | 485 | 9.8 | 382 | 433 | 6.1 |
| 100 | 1 | 449 | 474 | 13 | 425 | 458 | 11 | 374 | 423 | 6.5 |
| 150 | 1 | 404 | 417 | 14.3 | 403 | 424 | 13.6 | 366 | 404 | 7.6 |
| 170 | 1 | 403 | 416 | 16.3 | 382 | 400 | 13.6 | 382 | 389 | 9.6 |
| 200 | 1 | 355 | 372 | 18 | 348 | 368 | 13.8 | 340 | 359 | 12.2 |
| 220 | 1 | 340 | 351 | 18 | 324 | 344 | 14.2 | 301 | 332 | 12.4 |
| 250 | 1 | 268 | 282 | 19 | 250 | 268 | 16.1 | 282 | 300 | 14.7 |

Definitions Sample Directions:

L=longitudinal direction: parallel to the main form change direction

LT=long transverse direction: parallel to the width direction

ST=short transverse direction: parallel to the thickness direction

The improved strengths of the alloy according to the invention (for example alloy E) is clearly evident in Tables 2 and 3. For example, while the prior known alloy AA 2214 shows good strength values at ambient temperature, it does not at higher temperatures. Moreover, the creep resistance and the fracture toughness are markedly better at ambient temperature and at higher temperatures in the claimed alloy compared to the prior known alloys. This comparison makes clear that the tested prior known alloys have good properties only with respect to a single strength parameter. In no case do the prior alloys have good properties in all relevant strength values at ambient temperature as well as at increased temperatures. Just as is the case with the fatigue properties, the creep resistance of this prior known alloy is not satisfactory. Very good properties over all tested strength parameters could only be determined in the case of the alloy according to the invention.

FIG. 1 also makes graphically clear the better strength properties of the alloy (alloy E) according to the invention compared to the known alloys (AA 2214 as well as AA 2618). The results showed unexpectedly that the strength values of alloy E are better even at temperatures below 100° C. than those of the known alloy AA 2214, which is known for its especially high strength values in this temperature range.

Additionally, the creep resistance of the semi-finished products was tested. Table 4 shown below provides the test results (LMP: Larson Miller parameter) in summary:

TABLE 4

| Alloy | | | | | | | | | | | |
|---|---|---|---|---|---|---|---|---|---|---|---|
| E | | | | AA 2214 | | | | AA 2618 | | | |
| $T_{test}$ (° C.) | $\sigma_{test}$ (MPa) | $t_{fracture}$ (h) | LMP (—) | $T_{test}$ (° C.) | $\sigma_{test}$ (MPa) | $t_{fracture}$ (h) | LMP (—) | $T_{test}$ (° C.) | $\sigma_{test}$ (MPa) | $t_{fracture}$ (h) | LMP (—) |
| 180 | 185 | 2513 | 10.60 | 205 | 200 | 30 | 10.27 | 205 | 183 | 10 | 10.04 |
| | 167 | 4762 | 10.82 | | 190 | 50 | 10.38 | | 179 | 50 | 10.38 |
| | | | | | 181 | 100 | 10.52 | | 175 | 100 | 10.52 |
| | | | | | 130 | 500 | 10.85 | | 163 | 500 | 10.85 |
| | | | | | 100 | 800 | 10.95 | | 159 | 1000 | 11.00 |

Figure 2:
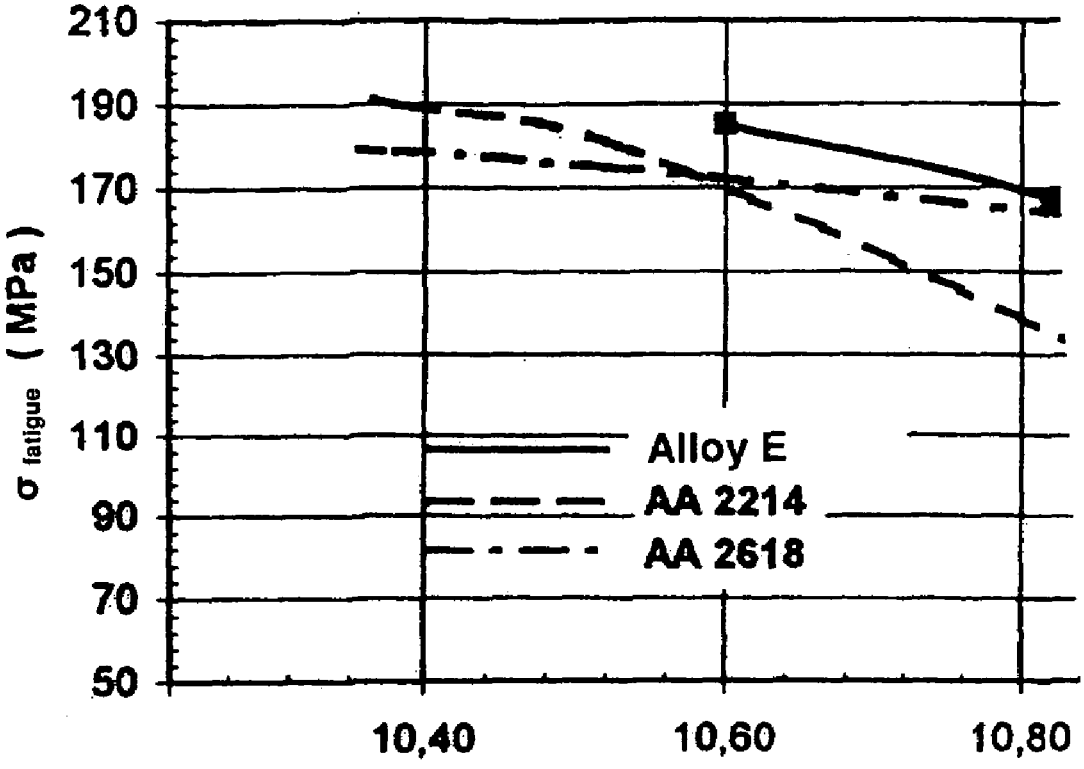
FIG. 2 is a graph showing the long-time stress to rupture strength of the alloy according to the invention in state T6 in comparison to known alloys.

Plotted graphically, the markedly better long-time stress to rupture strength of the alloy in the T6 state in comparison to the known alloys AA 2214 and AA 2618 in the T6 state is apparent. This is shown in FIG. 2 as time-compensated temperature representation. The especially good creep resistance of the alloy according to the invention could not be foreseen making this result surprising.

Within the scope of testing the method steps for the production of these semi-finished products, it was found that comparable material properties of the produced semi-finished products can be attained if the step of hot working is carried out at a block temperature between 320° C. to 460° C. The hot working can be either forging or rolling. The step of quenching of the solution treated semi-finished product can take place in a temperature range between ambient temperature and 100° C. (boiling) in water. It is also possible to utilize a water-glycol mixture for the quenching, the temperature of which-should not exceed 50° C.

A cold working step of a drawing out by 1% to 5% can be carried out in the case of extruded or rolled products for the purpose of reducing the intrinsic stresses due to the quenching instead of the previously described step of cold working through cold upsetting during forging. The step of artificial ageing can be carried out over a time period of 5 to 35 hours, preferably between 10 and 25 hours, in a temperature window between 170° C. and 210° C.

Figure 3:
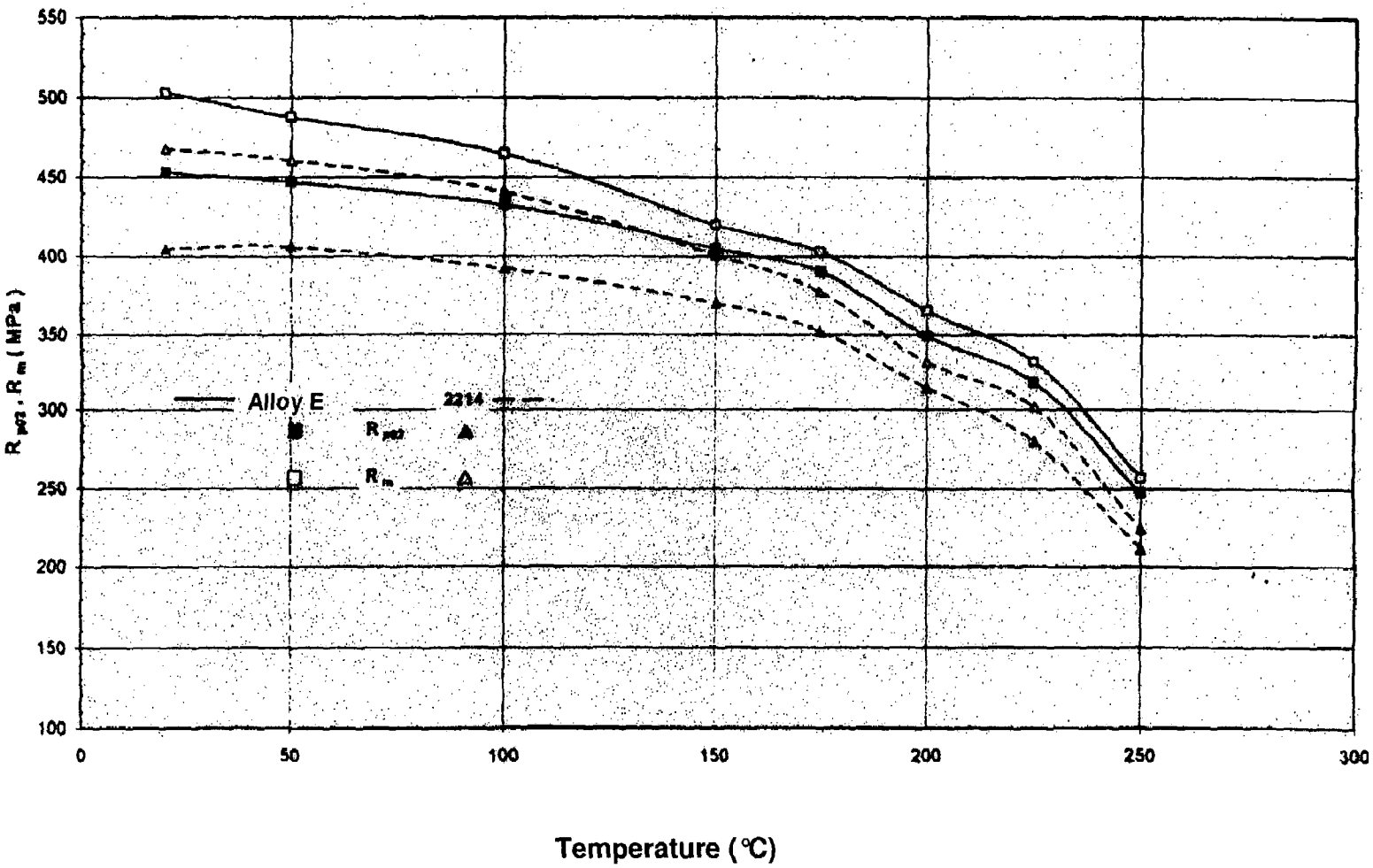
FIG. 3 is a graph showing the 0.2% yield strength and the tensile strength of airplane wheels manufactured from the alloy according to the invention in comparison to such manufactured from known alloys.

During further tests strand-cast ingots were produced as described above and airplane wheels manufactured by drop forging in the preforge die and finish forge die at a temperature of 410 to 430° C. These wheels were subsequently solution treated at 505° C., quenched in a mixture of water and glycol of ambient temperature and thermally age-hardened at 170° C. for 20 hours. These were compared to mass-produced airplane wheels of the alloy AA 2214. Samples were taken from the wheels produced of the claimed alloy and of the conventional alloy at sites distributed over the circumference, and tested for their tensile strength. The results are shown in FIG. 3. It can clearly be seen that the alloy E according to the invention yields better values compared to the known alloy AA 2214.

Figure 4A:
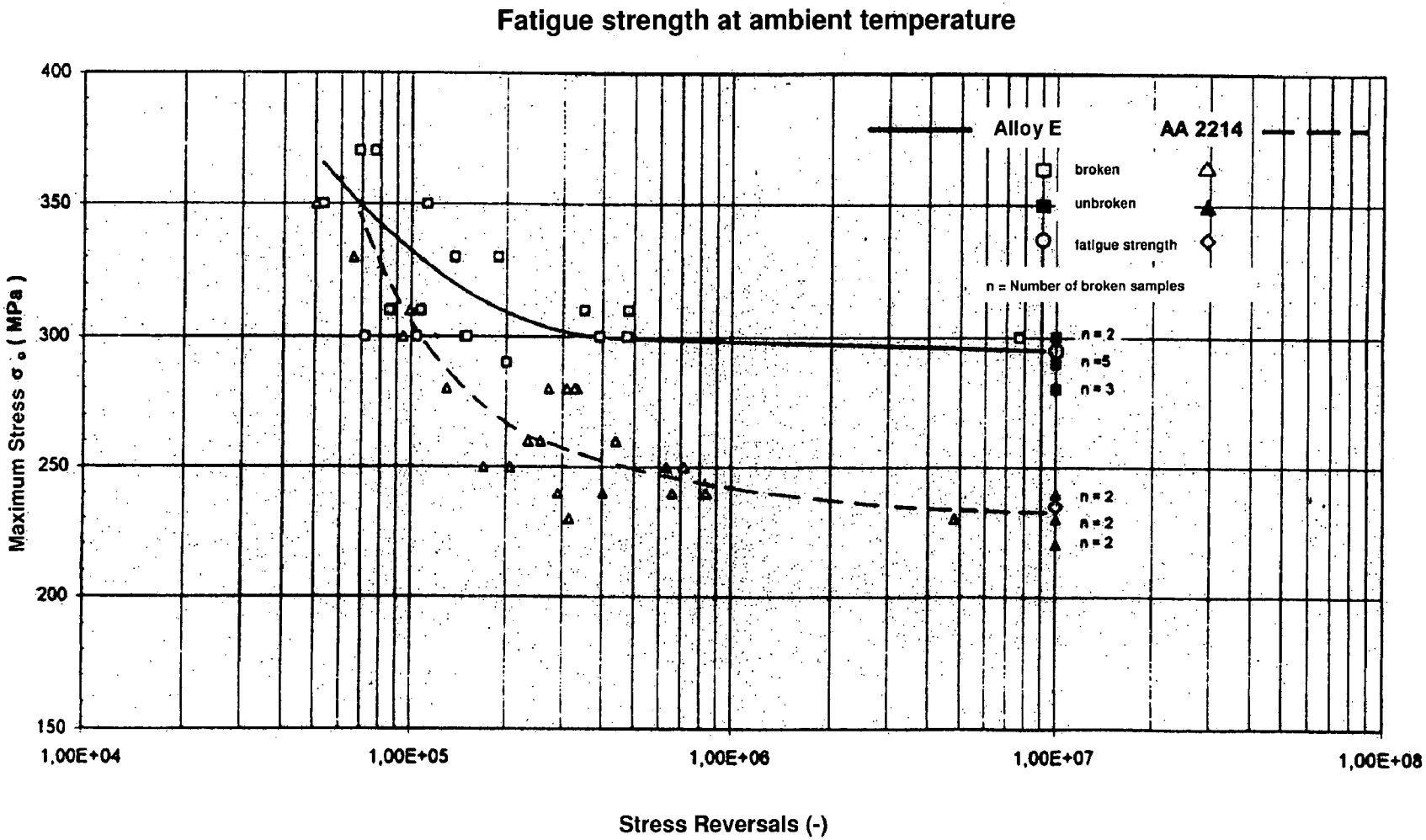
FIGS. 4*a* and 4*b* are graphs showing the fatigue strength of the alloy according to the invention in comparison to a known alloy in state T6 at ambient temperature and at a temperature of 200° C.
Figure 4B:
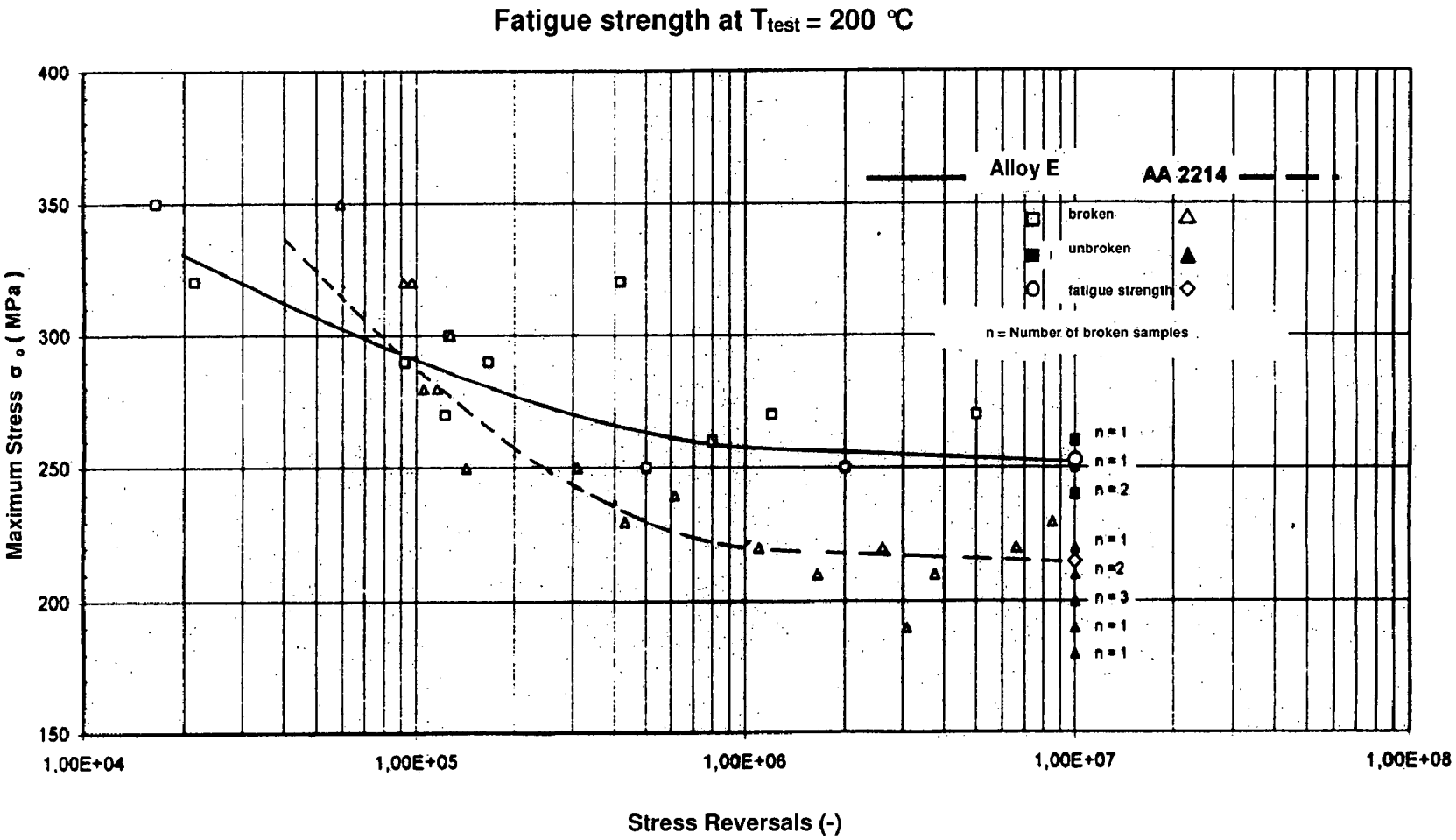

Fatigue tests in comparable samples of the two cited alloys also show that the wheels produced from the claimed alloy attain markedly better values than the wheels produced from the alloy AA 2214. This applies to the fatigue tests carried out at ambient temperature (cf. FIG. 4*a*) as well as to the fatigue tests carried out at a test temperature of 200° C. (cf. FIG. 4*b*).

The description of the claimed invention makes clear that surprisingly the claimed alloys have not only high dynamic and static strength values, but that they have an especially good high-temperature stability, fracture toughness and creep resistance. This alloy is therefore particularly suitable for the production of semi-finished products, which must meet precisely these requirements, such as airplane wheels or compressors.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. An Al/Cu/Mg/Mn alloy for the production of semi-finished products with high static and dynamic strength properties wherein the alloy comprises:

0.3–0.7 wt. % silicon (Si);
maximally 0.15 wt. % iron (Fe);
3.5–4.5 wt. % copper (Cu);
0.1–0.5 wt. % manganese (Mn);
0.3–0.8 wt. % magnesium (Mg);
0.05–0.15 wt. % titanium (Ti);
0.1–0.25 wt. % zirconium (Zr);
0.3–0.7 wt. % silver (Ag);
maximally 0.05 wt. % other, individually;
maximally 0.15 wt. % other, total; and
remaining wt. % aluminum (Al).

2. The alloy as claimed in claim 1, wherein the ratio of copper to magnesium is between 5 and 9.5.

3. The alloy as claimed in claim 2, wherein the copper content is 3.8–4.2 wt. % and the magnesium content 0.45–0.6 wt. % and the copper to magnesium ratio is between 6.3 and 9.3.

4. The alloy as claimed in one of claims 1 to 3, wherein the silver content is 0.45–0.6 wt. %.

5. The alloy as claimed in one of claims 1 to 3, wherein the silicon content is 0.4–0.6 wt. %.

6. The alloy as claimed in one of claims 1 to 3, wherein the manganese content is 0.2–0.4 wt. %.

7. The alloy as claimed in one of claims 1 to 3, wherein the zirconium content is 0.14 0.20 wt. %.

8. The alloy as claimed in one of claims 1 to 3, wherein the titanium content is 0.10 –0.1 wt. %.

9. The alloy as claimed in one of claims 1 to 3, wherein the titanium component for the production of the alloy is alloyed into it in the form of an Al/Ti/B prealloy and the boron fraction is 0.01–0.03 wt. %.

10. The alloy as claimed in one of claims 1 to 3, wherein the iron content of the alloy is maximally 0.10 wt. %.

11. A semi-finished product produced from an alloy as claimed in one of claims 1 to 3, wherein the semi-finished product is produced by a hot working process.

12. A method for the production of a semi-finished product as of an Al/Cu/Mg/Mn alloy, comprising the following steps:

a) making an alloy which comprises:
0.3–0.7 wt. % silicon (Si);
maximally 0.15 wt. % iron (Fe);
3.5–4.5 wt. % copper (Cu);
0.1–0.5 wt. % manganese (Mn);
0.3–0.8 wt. % magnesium (Mg);
0.05–0.15 wt. % titanium (Ti);
0.1–0.25 wt. % zirconium (Zr);
0.3–0.7 wt. % silver (Ag);
maximally 0.05 wt. % other, individually;
maximally 0.15 wt. % other, total; and
remaining wt. % aluminum (Al);

b) casting of an ingot from the alloy;

c) homogenizing the cast ingot at a temperature, which is as close under the incipient melting temperature of the alloy as is possible, for a length of time adequate to attain maximally uniform distribution of the alloy elements in the cast structure;

d) hot working of the homogenized ingot by forging at temperatures between 320° C. and 470° C.;

e) solution treatment of the worked semi-finished product at temperatures sufficiently high to bring the alloy elements necessary for the hardening into solution uniformly distributed in the structure, with the solution treatment taking place in a temperature range between 490 and 505° C. over a time period of 30 minutes to 5 hours;

f) quenching the solution-treated semi-finished product either in water at a maximum temperature of 100° C. or in a mixture of water and glycol at a temperature lower than or equal to 50° C.; and g) artificial ageing of the quenched semi-finished product at temperatures between 170 and 210° C. over a period of time of 5 hours to 35 hours.

13. A method for the production of a semi-finished product as of an Al/Cu/Mg/Mn alloy, comprising the following steps:

a) making an alloy which comprises:
0.3–0.7 wt. % silicon (Si);
maximally 0.15 wt. % iron (Fe);
3.5–4.5 wt. % copper (Cu);
0.1–0.5 wt. % manganese (Mn);
0.3–0.8 wt. % magnesium (Mg);
0.05–0.15 wt. % titanium (Ti);
0.1–0.25 wt. % zirconium (Zr);
0.3–0.7 wt. % silver (Ag);
maximally 0.05 wt. % other, individually;
maximally 0.15 wt. % other, total; and
remaining wt. % aluminum (Al);

b) casting of an ingot from the alloy;

c) homogenizing the cast ingot at a temperature, which is as close under the incipient melting temperature of the alloy as is possible, for a length of time adequate to attain maximally uniform distribution of the alloy elements in the cast structure;

d) hot working of the homogenized ingot by rolling at temperatures between 320° C. and 470° C.;

e) solution treatment of the worked semi-finished product at temperatures sufficiently high to bring the alloy elements necessary for the hardening into solution uniformly distributed in the structure, with the solution treatment taking place in a temperature range between 490 and 505° C. over a time period of 30 minutes to 5 hours;

f) quenching the solution-treated semi-finished product either in water at a maximum temperature of 100° C. or in a mixture of water and glycol at a temperature lower than or equal to 50° C.; and g) artificial ageing of the quenched semi-finished product at temperatures between 170 and 210° C. over a period of time of 5 hours to 35 hours.

14. The method as claimed in one of claims 12 or 13, wherein between the step of quenching and the step of artificial ageing a cold-working step is provided, in which the quenched semi-finished product is upset or drawn out by an amount between 1 and 5% in order to reduce the intrinsic stresses.

15. Method as claimed in claim 12 or 13, wherein the step of artificial ageing is carried out over a time period of 10 and 25 hours.

* * * * *